United States Patent [19]

Herrington et al.

[11] Patent Number: 4,702,042

[45] Date of Patent: Oct. 27, 1987

[54] CUTTING STRENGTHENED GLASS

[75] Inventors: Richard A. Herrington, Walbridge; Thomas G. Kleman, Northwood; Ermelinda A. Apolinar, Toledo, all of Ohio

[73] Assignee: Libbey-Owens-Ford Co., Toledo, Ohio

[21] Appl. No.: 723,578

[22] Filed: Apr. 15, 1985

Related U.S. Application Data

[63] Continuation-in-part of Ser. No. 654,975, Sep. 27, 1984, Pat. No. 4,656,791.

[51] Int. Cl.[4] ..... B24C 1/00

[52] U.S. Cl. ..... 51/321; 51/326; 83/53; 83/177

[58] Field of Search ..... 51/410, 319, 320, 321, 51/326; 83/53, 177

[56] References Cited

U.S. PATENT DOCUMENTS

| | | | |
|---|---|---|---|
| 2,985,050 | 5/1961 | Schwacha | 51/410 |
| 3,212,378 | 10/1965 | Rice | 51/321 |
| 3,532,014 | 10/1970 | Franz | 83/177 |
| 4,272,017 | 6/1981 | Franz | 83/53 |

OTHER PUBLICATIONS

"Abrasive Jet Machining", Tool and Manufacturing Engineer, Nov. 1967; Ingulli.

*Primary Examiner*—Frederick R. Schmidt
*Assistant Examiner*—Robert A. Rose
*Attorney, Agent, or Firm*—Marshall & Melhorn

[57] ABSTRACT

Cutting strengthened glass by means of a high velocity fluid jet. A suitable fluid is placed under high pressure and directed against the surface of the glass in a highly collimated stream of small diameter at high velocity. Very fine abrasive particles are aspirated into the high velocity stream prior to its impingement upon the glass to serve as a cutting medium for the strengthened glass. The pressure of the fluid is reduced when starting the cut to avoid venting of the glass during initial penetration, and the pressure is then increased for movement of the fluid jet along the desired line of cut. The relationship between fluid pressure, line speed and abrasive grit size is carefully controlled to produce a smooth cut free from vents and chips so as to avoid failure of the strengthened unit.

13 Claims, 2 Drawing Figures

CUTTING STRENGTHENED GLASS

CROSS REFERENCE TO RELATED APPLICATION

The present application is a continuation-in-part application of copending application Ser. No. 654,975 filed Sept. 27, 1984, now U.S. Pat. No. 4,656,791 and assigned to the assignee of the present invention.

BACKGROUND OF THE INVENTION

1. Field of the Invention

The present invention pertains generally to the severing of glass, and more particularly to the cutting, piercing or edging of so-called heat strengthened glass, that is, glass having a surface compression in the range defined by United States government standards and generally understood in the industry as being heat strengthened, by means of an abrasive fluid jet directed against the glass.

2. Description of the Prior Art

Strengthening of glass may be accomplished by heating the glass to a temperature above its strain point but below its softening point, and then rapidly chilling it as by blowing cooler air against its surfaces, whereupon the surfaces or external layers of the glass are placed in compression and the core is placed in tension. Such strengthening of the glass produces a highly desirable improvement in the mechanical properties of the glass and causes it, when severely damaged as by a heavy blow or scratching of the compressive surface layer, to break into relatively harmless fragments. This latter property, whereby the glass separates into relatively harmless fragments, is highly desirable for permitting the glass to be employed as safety glazing closures as, for example, in store fronts, sky lights and other architectural glazings.

Inasmuch as severe damage to the compressive surface layer may cause the glass to fracture in a random pattern, the use of conventional glass cutting techniques involving scoring the surface and breaking along the score line, as well as the usual drilling techniques, are precluded. For that reason it has heretofore been necessary to fabricate the glass unit to its final size and configuration, and to then strengthen the glass as a final step. As will be readily apparent, such a procedure has certain disadvantages. For example, glass doors and architectural glazings are produced in many different sizes and since it has not been possible to cut the strengthened glass required by safety codes in such installations, it is necessary for replacement glass installers to either stock a great many sizes of units, or have the units custom made to the required dimensions. As a result, there may be considerable delay as well as expense in obtaining the lights, and consequently much of the replacement market has gone to substitute materials such as plastic. Also, due to the complicated shapes and special features contemplated in glazing closures for future structures, it may not be feasible to strengthen the glazing closures for these structures after they are fabricated.

The desirability of being able to cut or otherwise fabricate so-called stressed or strengthened glass has long been recognized. To that end, a number of proposals have been made to modify the internal stresses within the glass whereby even though the glass is strengthened, it may still be cut in the conventional manner by scoring the surface and then running the cut along the score line. Thus, U.S. Pat. No. 3,107,196 suggests procedures for forming stressed or tempered glass sheets wherein there is little, if any, compression at the actual surfaces of the sheets, so that the glass can purportedly be cut by conventional scoring and flexing techniques. U.S. Pat. No. 3,150,950 discloses a method for cutting, drilling or edging tempered glass wherein previously tempered glass is heated to a temperature below its strain region and then rapidly cooled to induce temporary stresses into the glass which counteract the permanent stress, and the glass is then scored and separated while the temporary stress is present. Such methods have not proven entirely satisfactory in commercial practice, particularly for cutting irregular and curved shapes from strengthened glass units as is necessary in many instances.

SUMMARY OF THE INVENTION

In accordance with the present invention, strengthened glass is cut without the necessity for special treatment of the glass itself. Thus, strengthened glass can be produced in the conventional manner in standard sizes, for example, and then subsequently cut to desired dimensions. Likewise, relatively complicated curved glazing units can be fabricated and strengthened, and appropriate openings then cut in the units. The glass is firmly supported along the path which the cut is to follow, and a high velocity fluid jet, into which a fine abrasive material is aspirated in carefully controlled amounts, is directed against the glass surface in a highly concentrated stream. The pressure at which the fluid is discharged is maintained at a lower level during initial penetration of the glass, and is then increased to a substantially higher level for cutting the prescribed path along the glass. It is believed the ability to sever the strengthened glass without causing it to rupture or shatter as might be anticipated from known stress conditions within the glass and prior experience with conventional cutting procedures, may be due to a combination of characteristics of the novel procedure. Among these are the facts that minimal stress and heat are created in the glass by the cutting procedure, the cut extends entirely through the glass from one surface to the other almost simultaneously so that the compression and tension forces in the surface and interior portions are not greatly unbalanced by the cutting process, and the abrasive removal of the glass particles in minute form permits redistribution of the stresses as the cut progresses.

It is, therefore, a primary object of the invention to provide a process for cutting strengthened glass.

Another object of the invention is to provide a process for cutting strengthened glass which does not require modification of the stress pattern in the glass prior to cutting.

Another object of the invention is to provide a process capable of cutting irregularly shaped patterns from strengthened glass articles.

Still another object is to permit formation of openings in glass parts after they have been fabricated and strengthened.

Other objects and advantages will become more apparent during the course of the following description when taken in connection with the accompanying drawings.

BRIEF DESCRIPTION OF THE DRAWINGS

In the drawings, wherein like numerals refer to like parts throughout.

DESCRIPTION OF THE PREFERRED EMBODIMENTS

Figure 1:
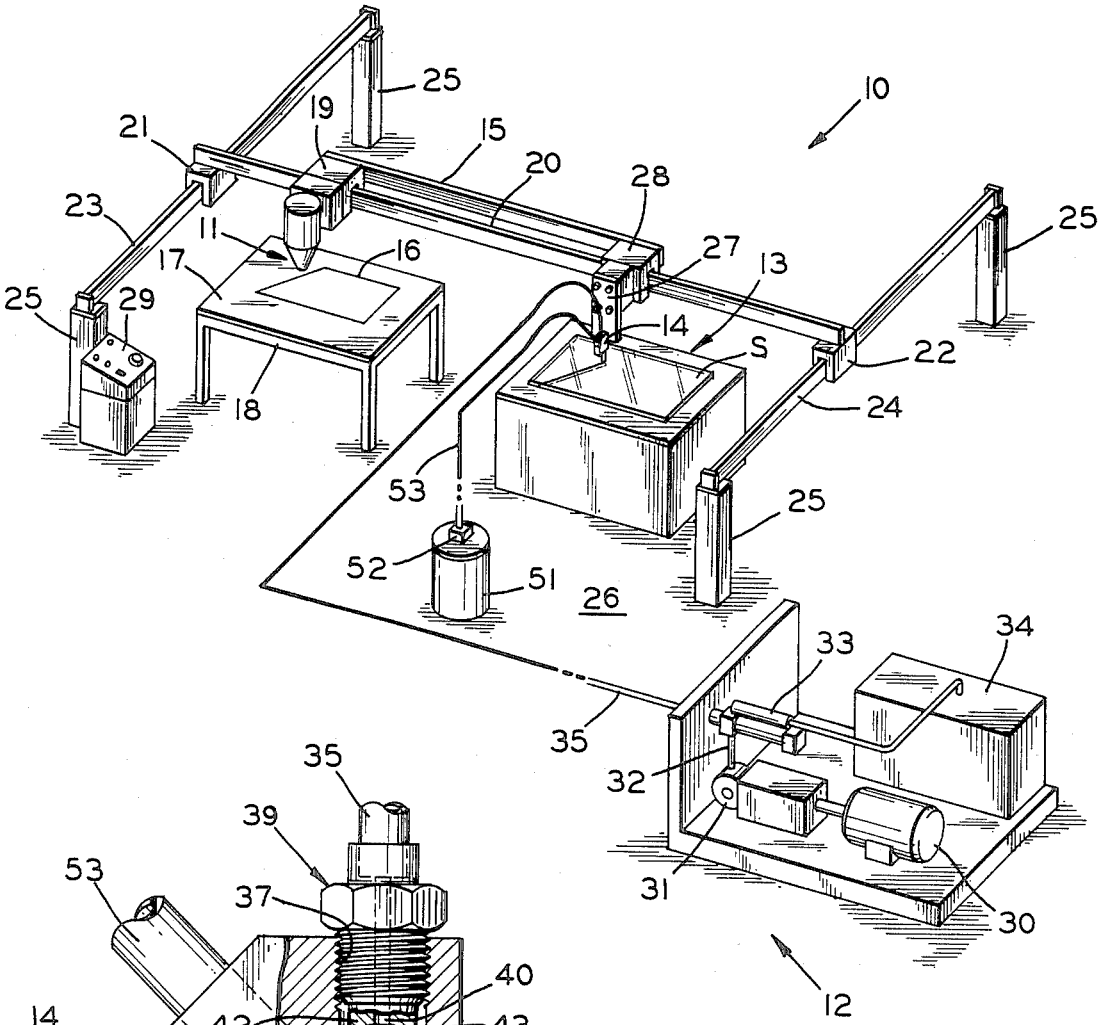
FIG. 1 is a schematic perspective view of a system for practicing the invention.

Referring now to the drawings, there is illustrated schematically at 10 in FIG. 1 a system which may be employed in cutting strengthened glass sheets in accordance with the invention. More particularly, the system is adapted for cutting glass sheets or blanks along prescribed lines and includes an optical tracer apparatus 11 and an abrasive fluid jet cutting apparatus, generally designated 12. The cutting apparatus 12 includes a support stand 13 adapted to firmly support a strengthened glass sheet S, as on a sacrificial support plate, for cutting as will be hereinafter more fully described. While the illustrated system represents a preferred embodiment for practicing the invention, as will be readily appreciated the invention is not limited to use with such a system but also has utility with other and different equipment.

In the illustrated embodiment the fluid jet cutting apparatus 11 includes a discharge or nozzle assembly 14, as will be hereinafter more fully described, mechanically connected to the optical tracer 11 by means of a tie bar 15. The tracer is provided for guiding the movement of the nozzle assembly 14 in accordance with a template or pattern 16 on a plate member 17 mounted on a table 18. The optical tracer 11 is affixed to a carriage 19 slidably mounted on an elongated transverse track 20 which is provided at its opposite ends with a pair of carriages 21 and 22. The carriages 21 and 22 are slidably mounted in parallel tracks 23 and 24, respectively, supported by stanchion members 25 on a floor 26. The nozzle assembly 14 is affixed as by a plate 27, to a carriage 28 also slidably mounted on the transverse track 20. The carriage 28 is rigidly connected in spaced relationship to the carriage 19 by the tie bar 15, with the spacing between the carriages 19 and 28 being such that the optical tracer 11 and the nozzle assembly 14 overlie the plate 17 and the support stand 13, respectively.

Thus as will be readily appreciated, with the above described carriage system the tracer 11 is capable of movement in any direction longitudinally, laterally or diagonally, with the carriage 28 and nozzle assembly 14 following the same motion due to the union of the carriages 19 and 28 by the tie bar 15 and the track 20. In operation, as the tracer 11 follows the outline or pattern 16, the fluid jet cutting nozzle 14, via the carriage 28, is caused to move correspondingly over the support stand 13 and the strengthened glass sheet S thereon. Control of the tracer functions such as power on/off, speed, automatic and manual operation, etc., may be affected as from a conveniently located control panel 29.

The fluid jet cutting apparatus itself as shown schematically in FIG. 1, includes an electric motor 30 driving a hydraulic pump 31, which in turn supplies working fluid through a conduit 32 to a high pressure intensifier unit 33. The function of the intensifier unit 33 is to draw in fluid (for example, deionized water) from a suitable source, such as a reservoir 34, and place it under a very high pressure which may be variably controlled, generally on the order of 10,000 to 30,000 psi., for discharge through a conduit 35. Mounted at the discharge end of the conduit 35 is nozzle assembly 14 for directing a very high velocity, small diameter fluid jet toward the strengthened glass sheet S upon the support stand 13.

Figure 2:
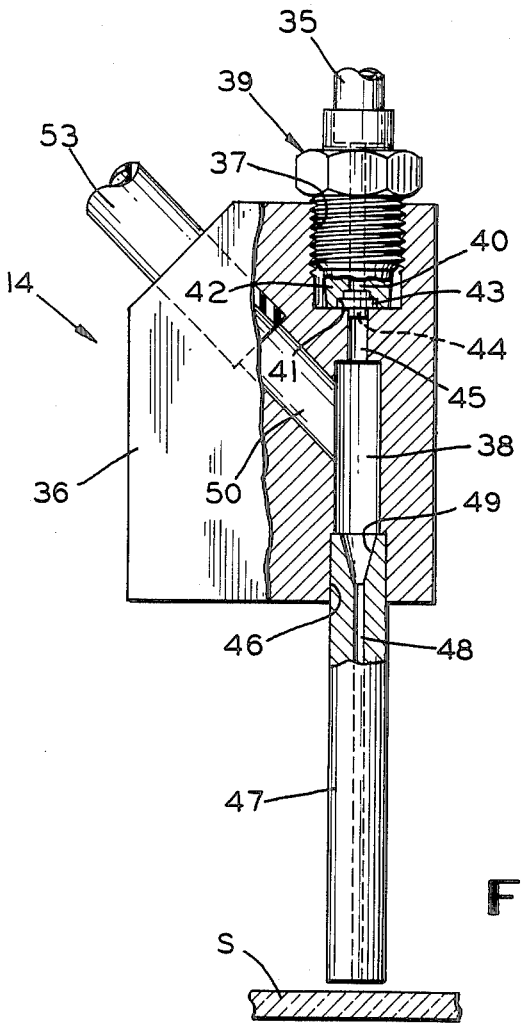
FIG. 2 is an enlarged side elevational view, partly in section, of a jet nozzle assembly employed in cutting strengthened glass by means of an abrasive fluid jet.

As best shown in FIG. 2, the nozzle assembly 14 comprises a generally rectangular housing 36 having a threaded bore 37 at its upper end, axially aligned with a flow passageway 38 extending through the housing. An externally threaded connector 39, having a flow passageway 40 extending therethrough, is suitably attached to the discharge end of the conduit 35 for connecting the conduit to the housing. A recess 41 is provided in a boss 42 at the threaded end of the connector 39, within which is mounted a fluid jet orifice 43 having a discharge opening 44 of very small, for example 0.014 inch (0.35 mm), diameter. When securely threaded in the bore 37, the connector 39 properly seats the orifice 43 in the upper, reduced diameter portion 45 of the flow passageway 38. The lower end of the passageway 38 includes an enlarged diameter portion 46 for receiving a nozzle or mixing tube 47. The nozzle tube includes a relatively small diameter (e.g., 0.062 inch; 1.57 mm) longitudinal passageway 48 with an outwardly flaired entrance opening 49 for more readily receiving the jet stream from the orifice 43.

Obliquely oriented to the passageway 38 is a bore 50 for delivering abrasive material, as will be hereinfter more fully described, into the path of the fluid jet stream. A regulated supply of the abrasive is carried from a storage container 51 and regulator 52 to the bore 50 by means of a flexible conduit or carrier tube 53. The abrasive material is aspirated into the fluid jet stream as the stream passes through the passageway 38, wherein it is mixed and accelerated into the high pressure stream prior to entering the passageway 48 in the nozzle tube 47. In operation, the exit end of the tube 47 is generally positioned relatively close to the surface of the workpiece, as will be more fully described, in order to minimize dispersion of the jet stream and thus provide a minimum kerf or impingement area width. It will be appreciated that the aforedescribed nozzle assembly is only intended to be representative of those which may be employed in practicing the invention.

In cutting strengthened glass in accordance with the invention a number of factors must be properly correlated and controlled in order to successfully sever the glass without causing it to be damaged or destroyed. It has been found that factors such as the type and particle size of abrasive material, type of fluid medium and degree to which it is pressurized, feed rate of the abrasive material, diameter of the orifice discharge opening 44, length and diameter of the passageway 48 in the nozzle tube 47, distance of the nozzle from the glass surface, thickness of the glass, and rate of progression of the cutting jet along the glass, all interact and must be properly correlated to enable the glass to be successfully cut.

A number of products are commercially available for use as the abrasive medium, including those sold under the names Biasil, Zircon 'M', Florida Zircon, Zircon 'T', Idaho Garnet, Barton Garnet, O-I Sand and Rock Quartz. The products are available in a range of nominal sizes extending from 60 grit or coarser to 220 grit or finer, and it has been found that while annealed glass can be successfully cut using the coarser 60 and 100 grit particles at relatively high line speeds, strengthened glass may not be cut in the same manner. Thus, the larger grit sizes at high line speeds cause the glass to vent at the cut, that is, to develop cracks extending into the adjacent glass body causing it to be unuseable if not to actually shatter. Use of 150 grit or finer abrasive particles permits the strengthened glass to be successfully cut at a much higher line speed.

The fluid generally employed in the cutting system is deionized water, pressurized in the high pressure intensifier, to pressures on the order of 10,000 to 30,000 psi, for discharge through the nozzle assembly. While the higher pressure permits use of a faster line speed in cutting strengthened glass, it has been found that when initial penetration occurs with the pressure at the higher level, venting of the glass at the cut surface is likely to occur. For that reason, in accordance with the invention, initial penetration of the glass is preferably made at a pressure on the order of 10,000 psi and then, as cutting proceeds, the pressure is increased or ramped to about 30,000 psi in order to permit a faster line speed. Once initial penetration of the glass is made, it has been found the line speed can be substantially increased at the higher pressure without causing venting. If the line speed becomes excessive, venting may again occur, however.

One embodiment of the apparatus successfully employed in cutting strengthened glass employed a jeweled orifice 43 having a discharge opening 44 of 0.014 inch (0.36 mm) diameter with a nozzle tube 47 having a length of 2 inches (50.8 mm) and a passageway 48 therethrough 0.074 inch (1.88 mm) in diameter. The end of the nozzle tube is located 0.052 inch (1.32 mm) from the surface of the glass sheet S.

As indicated above, there are a number of materials which may be employed as the abrasive medium. However, inasmuch as many of the materials including the sand, the different types of Zircon and the rock quartz, are mined from naturally occurring deposits which may not be further processed, the available grit sizes and degree of purity may be limited to those in the deposit, and thus they may not be acceptable for cutting strengthened glass in accordance with the invention. Because it is readily available with the purity and in the grit sizes required, Barton garnet, available from the Barton Mines Corporation of North Creek, N.Y., is well suited for use with the process. It will be understood, however, that other materials, where available in the proper grit sizes and with suitable purity, will perform equally well.

EXAMPLE 1

In a trial, three lights of regular heat strengthened glass ¼ inch (6.4 mm) thick and 24 inches (610 mm) by 24 inches (610 mm) in size, were cut in accordance with the invention. The average surface compression for the three heat strengthened lights, calculated from measurements with a quartz wedge, was 5215 psi. A jewel orifice 43 having a discharge opening with a diameter of 0.014 inch (.36 mm) was employed, along with a nozzle tube 47 two inches (50.8 mm) in length, having a passageway 48 with a diameter of 0.074 inch (1.88 mm) and with its exit opening spaced 0.052 inch (1.32 mm) from the surface of the glass. Deionized water was supplied to the nozzle as the fluid medium, and 100 grit Barton garnet was aspirated into the fluid stream through the bore 50 of the carrier tube 53 at a rate of one pound (0.45 kg) per minute. An initial penetration of the glass was made at a fluid jet pressure of 10,000 psi and, after the initial penetration, the pressure was ramped or increased to 30,000 psi. A good quality cut was accomplished at a line speed of 5 inches (127 mm) per minute. Upon increasing the line speed to 10 inches (254 mm) per minute, it was found that venting occurred at the cut edge, with the vents generally running into the central part of the light.

EXAMPLE 2

Another cutting trial was conducted with two lights of ¼ inch (6.4 mm) regular heat strengthened glass 24 inches by 24 inches (610 mm by 610 mm) in size. The average surface compression of these lights, calculated from measurements with a quartz wedge, was 5170 psi. The parameters employed were the same as those employed in example 1 except that a 150 grit Barton garnet was aspirated into the cutting stream at a feed rate of 1 pound (0.45 kg) per minute. A cut of good quality was achieved at a line speed of 20 inches (508 mm) per minute. However, it was found that increasing the line speed significantly above that rate resulted in venting at the cut edge, with the vents generally running into the central part of the light.

The tests thus indicate that at higher line speeds a better quality cut is achieved by using a finer 150 grit garnet as the abrasive medium than by using a coarser 100 grit garnet. Conversely, use of the finer grit garnet permits achievement of acceptable quality cuts at substantially higher line speeds than are possible with the coarser garnet. It is extremely important to the durability of the cut strengthened glass unit that the edges of the cut be smooth and free from chips and vents, and therefore the relationship between line speed, pressure and abrasive grit size must be such as to produce a cut of high quality. Of course, in cutting thicker glass the line speed will be slower than, while in cutting thinner glass it may be faster than, those indicated by the aforementioned examples.

It will thus be readily apparent that strengthened glass may be successfully cut in accordance with the teaching of the invention without special treatment of the glass itself.

It is to be understood that the form of the invention herewith shown and described is to be taken as an illustrative embodiment only of the same, and that various changes in the shape, size and arrangement of parts, as well as various procedural changes, may be resorted to without departing from the spirit of the invention.

We claim:

1. A method of cutting a sheet of heat strengthened glass having its major surfaces in compression and its interior in tension, by means of an abrasive fluid jet, comprising supporting the sheet upon one of its major surfaces, directing a highly concentrated fluid jet into which abrasive particles have been introduced against the other major surface of said sheet at a first, lower cutting pressure on the order of 10,000 psi to initially penetrate the sheet without causing venting and chipping of the heat strengthened glass along the initial cut, substantially increasing the pressure of the fluid to a second, higher cutting level on the order of 30,000 psi after the initial penetration, moving the abrasive fluid jet relative to the sheet of glass along the desired line of cut with the cutting pressure at the higher level, and establishing the line speed of the fluid jet relative to the glass at the second cutting pressure so as to produce a smooth cut wherein the adjacent heat strengthened glass is free from vents and chips.

2. A method of cutting a sheet of strengthened glass as claimed in claim 1, wherein said fluid jet is discharged toward said surface of said sheet with a diameter not greater than about 0.074 inch (1.88 mm).

3. A method of cutting a sheet of strengthened glass as claimed in claim 1, wherein said fluid jet is directed against said surface of said sheet from a distance not greater than about 0.052 inch (1.32 mm).

4. A method of cutting a sheet of strengthened glass as claimed in claim 1, wherein said abrasive particles are of nominal 100 grit size.

5. A method of cutting a sheet of strengthened glass as claimed in claim 1, wherein said abrasive particles are introduced to said fluid jet at a rate of about one pound (0.45 kg) per minute).

6. A method of cutting a sheet of strengthened glass as claimed in claim 2, wherein said fluid jet is directed against said surface of said sheet from a distance of about 0.052 inch (1.32 mm) and said abrasive particles are of nominal 100 grit size.

7. A method of cutting a sheet of strengthened glass as claimed in claim 6, wherein said abrasive particles are garnet and are introduced to said fluid jet at a rate of about one pound (0.45 kg) per minute.

8. A method of cutting a sheet of strengthened glass as claimed in claim 7, wherein said sheet comprises a sheet of heat strengthened glass about ¼ inch (6.4 mm) thick, and said abrasive fluid jet is moved along the desired line of cut at a line speed less than about 10 inches (254 mm) per minute.

9. A method of cutting a sheet of strengthened glass as claimed in claim 8, wherein said abrasive fluid jet is moved relative to said glass sheet at a line speed of about 5 inches (127 mm) per minute.

10. A method of cutting a sheet of strengthened glass as claimed in claim 1, wherein said abrasive particles are of nominal 150 grit size.

11. A method of cutting a sheet of strengthened glass as claimed in claim 10, wherein said fluid jet is discharged toward said other major surface of said sheet with a diameter not greater than about 0.074 inch (1.88 mm) at a distance of about 0.052 inch (1.32 mm) from said other surfaces, and said abrasive particles are introduced to said fluid jet at a rate of about one pound (0.45 kg) per minute.

12. A method of cutting a sheet of strengthened glass as claimed in claim 11, wherein said sheet comprises a sheet of ¼ inch (6.4 mm) heat strengthened glass, said abrasive particles being Barton garnet, and said abrasive fluid jet is moved along the desired line of cut at a line speed not greater than about 20 inches (508 mm) per minute.

13. A method of cutting a sheet of strengthened glass as claimed in claim 12, wherein said line speed is about 20 inches (508 mm) per minute.

* * * * *